US009482040B2

(12) United States Patent
Pettersson et al.

(10) Patent No.: US 9,482,040 B2
(45) Date of Patent: Nov. 1, 2016

(54) FITTING FOR A SLIDING DOOR

(75) Inventors: Jimmy Pettersson, Almhult (SE); Johan Northfell, Karishamn (SE)

(73) Assignee: INTER IKEA SYSTEMS B.V., Delft (NL)

( * ) Notice: Subject to any disclaimer, the term of this patent is extended or adjusted under 35 U.S.C. 154(b) by 0 days.

(21) Appl. No.: 14/128,856

(22) PCT Filed: Jun. 21, 2012

(86) PCT No.: PCT/EP2012/061979
§ 371 (c)(1),
(2), (4) Date: May 29, 2014

(87) PCT Pub. No.: WO2012/175618
PCT Pub. Date: Dec. 27, 2012

(65) Prior Publication Data

US 2014/0250793 A1 Sep. 11, 2014

(30) Foreign Application Priority Data

Jun. 23, 2011 (SE) ..... 1150588

(51) Int. Cl.
*E05D 15/06* (2006.01)
*E06B 3/46* (2006.01)

(52) U.S. Cl.
CPC ..... *E05D 15/0621* (2013.01); *E05D 15/063* (2013.01); *E06B 3/4636* (2013.01); (Continued)

(58) Field of Classification Search
CPC ..... E06B 3/46; E06B 3/4636; E05D 15/06; E05D 15/0626; E05D 15/063; E05D 15/0621; Y10T 16/364
See application file for complete search history.

(56) References Cited

U.S. PATENT DOCUMENTS 1,008,910 A * 11/1911 Hill ..... E05D 15/063 16/107
3,425,162 A * 2/1969 Halpern ..... E05D 15/0634 16/105

(Continued)

FOREIGN PATENT DOCUMENTS

DE 20 2005 00768 9/2006
DE 20 2005 012 051 12/2006

(Continued)

OTHER PUBLICATIONS

International Search Report for International Application No. PCT/EP2012/061979 mailed Oct. 9, 2012 (3 pages).

(Continued)

*Primary Examiner* — Brian Mattei
*Assistant Examiner* — Catherine A Kelly
(74) *Attorney, Agent, or Firm* — Merchant & Gould P.C.

(57) ABSTRACT

A fitting (1) for suspending a sliding door leaf (D) is provided. Said fitting (1) comprises a base plate (2) having means (8, 9) for attaching said base plate (2) to a door leaf (D), support means (3) attached to said base plate (2) for allowing said fitting (1) to be guided by a rail (R) along a sliding path (P), and a shank (5) having a part (5*b*, 5*d*) extending from a lateral end of said base plate (2) at an angle (α, β) relative a plane of the base plate. Said fitting (1) further comprises an anti-lifting device (4) attached to said shank (5) and being moveable between an idle position and a locked position by a rotational movement of the anti-lifting device (4) about an axis (A) being substantially perpendicular to a plane of said shank part (5*b*, 5*d*).

13 Claims, 2 Drawing Sheets

(52) U.S. Cl.
CPC ..... *E05Y2201/41* (2013.01); *E05Y 2201/614* (2013.01); *E05Y 2600/322* (2013.01); *E05Y 2900/132* (2013.01); *Y10T 16/364* (2015.01)

(56) References Cited

U.S. PATENT DOCUMENTS

| | | | | |
|---|---|---|---|---|
| 6,381,904 | B1 * | 5/2002 | Tedescucci | A47K 3/34 16/87.4 R |
| 9,038,316 | B2 * | 5/2015 | Von Gerichten | E05D 15/063 49/360 |
| 2002/0170234 | A1 * | 11/2002 | Salice | 49/453 |
| 2009/0120006 | A1 * | 5/2009 | Vincent | 49/414 |
| 2009/0229184 | A1 * | 9/2009 | Hideki | B66B 13/08 49/70 |
| 2010/0320887 | A1 * | 12/2010 | Bortoluzzi | 312/312 |

FOREIGN PATENT DOCUMENTS

| | | |
|---|---|---|
| DE | 20 2008 01085 | 1/2010 |
| DE | 20 2009 00526 | 1/2011 |
| EP | 1 388 631 | 2/2004 |
| WO | 2010094564 A1 | 8/2010 |

OTHER PUBLICATIONS

Chinese Office Action for corresponding CN Application No. 201280030632.1 mailed Feb. 13, 2015 (English Translation provided), 13 pages.

* cited by examiner

FITTING FOR A SLIDING DOOR

This application is a National Stage Application of PCT/EP2012/061979, filed 21 Jun. 2012, which claims benefit of Serial No. 1150588-0, filed 23 Jun. 2011 in Sweden and which applications are incorporated herein by reference. To the extent appropriate, a claim of priority is made to each of the above disclosed applications.

FIELD OF THE INVENTION

The present invention relates to fitting for suspending a sliding door leaf. More particularly, the present invention relates to a fitting having an anti-lifting device for preventing unintentional removal of a sliding door from its suspended position.

BACKGROUND

Sliding doors are typically suspended using fittings provided with supporting wheels configured to support the door for sliding/rolling movement along a guiding rail. Sometimes, the fittings are provided with a movable stop member for selectively allowing or preventing removal of a sliding door from its suspended position.

One such fitting is described in EP1388631, in which the moveable stop member is reachable from the space between the upper end of the fitting and the guiding rail, and arranged to move into a locked position by manually pushing the stop member in a direction perpendicular to the sliding direction of the sliding door.

Such solution is rather cumbersome to handle from a user perspective, and there is thus a need for an improved fitting having anti-lifting functionality.

Further, sliding door systems are often provided with a self-closing mechanism for automatically pulling the sliding doors into the closed position and/or dampening the impact of a door being pushed to its open position. For this purpose, the sliding door may be equipped with an engagement device for engaging with the self-closing mechanism.

A problem of such opening/closing devices is that the devices are prone to break when a door is intentionally or unintentionally lifted off its normal hanging position, due to its engagement with the door. A fitting which mitigates one or more of the above described deficiencies would thus be beneficial.

SUMMARY

An object of the invention is to provide a fitting which enables safe removal of a sliding door from its normal position on a guiding rail, such that damages to door, bracket and/or and any associated soft-close or push-open device is prevented.

A further object of the present invention is to provide a more user friendly fitting for facilitating the mounting and dismounting of the door.

A yet further object of the present invention is to provide a more versatile fitting thus reducing the number of components of the sliding door system.

This and other objects are achieved by a fitting, a door leaf, a sliding door system, and a method according to the appended claims.

According to a first aspect of the invention, a fitting for suspending a sliding door leaf is provided. Said fitting comprises a base plate having means for attaching said base plate to a door leaf, support means attached to said base plate for allowing said fitting to be guided by a rail along a sliding path, and a shank having a part extending from a lateral end of said base plate at an angle relative a plane of the base plate, wherein said fitting further comprises an anti-lifting device attached to said shank and being moveable between an idle position and a locked position by a rotational movement of the anti-lifting device about an axis being substantially perpendicular to a plane of the shank part.

Since the rotational axis is parallel to the sliding path of the bracket, forces from a self-closing device acting on the anti-lifting device will not cause rotation of the anti-lifting device.

Further, since the anti-lifting device extends from a lateral edge of the base plate substantially perpendicularly from said plate it is easy to reach, see and move the anti-lifting device between the idle position and the locked position. Also, one can more easily control that the anti-lifting device and an associated device, such as a self-closing device or push-open device, are disengaged before the door is lifted off. This in turn reduces the risk of damages to the associated device and the bracket.

According to a second aspect of the invention, a door leaf comprising a fitting according to the first aspect of the invention is provided.

According to a third aspect of the invention, a sliding door system comprising a guiding rail and at least one door leaf according to the second aspect of the invention is provided.

Said guiding rail may comprise a self-closing device arranged such that the self-closing device is engageable with the anti-lifting device in its locked position but not in its idle position.

According to a fourth aspect of the invention, a method for providing a sliding door system is provided. The method comprises the steps of providing a door leaf according to the second aspect of the invention, move the anti-lifting device of the fitting of the door leaf into the idle position, suspend said door leaf on a guiding rail, and move the anti-lifting device of the fitting of the door leaf from the idle position to the locked position for preventing the door leaf from being dismounted from said guiding rail.

The advantages of the first aspect are also applicable for the second, third, and fourth aspects.

BRIEF DESCRIPTION OF DRAWINGS

Embodiments of the present invention will now be described with reference to the appended drawings, in which.

DETAILED DESCRIPTION

Figure 1:
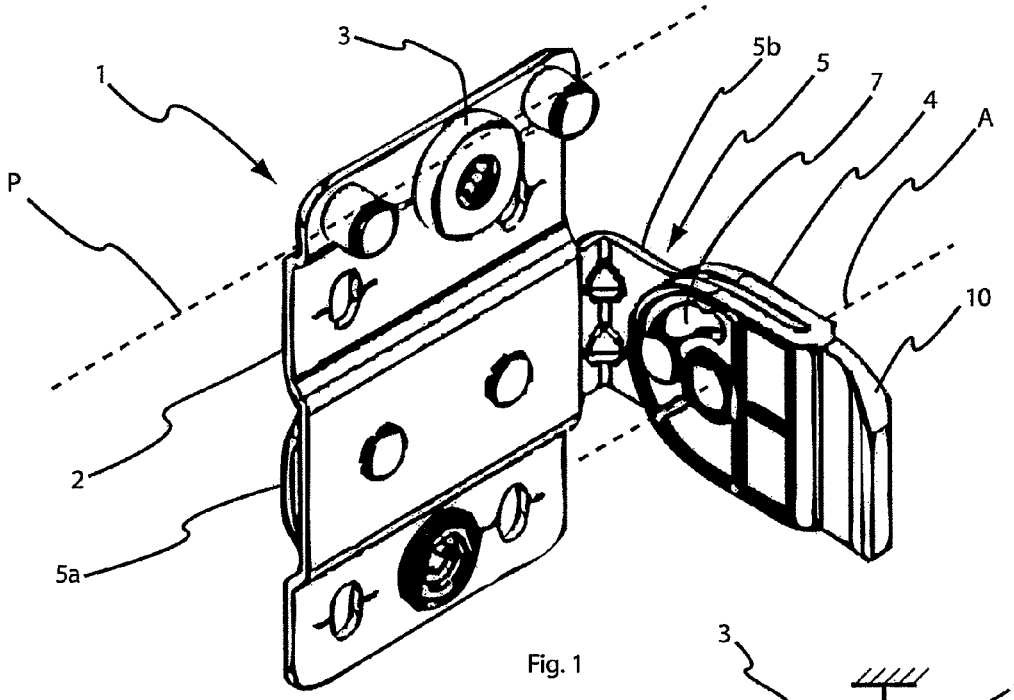
FIG. 1 shows a perspective view of a fitting according to an embodiment of the invention.
Figure 2:
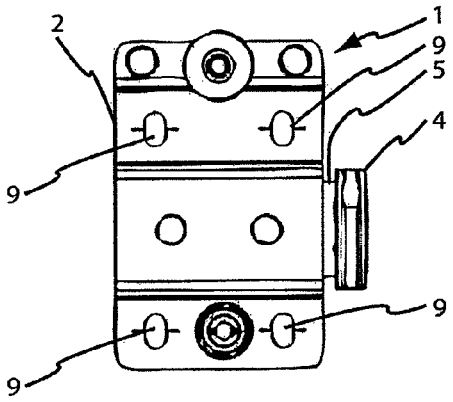
FIG. 2 shows a front view of the fitting shown in FIG. 1.

With reference to FIGS. 1 to 4, a fitting 1 for a sliding door leaf is shown. The fitting 1 is suitable for suspending a door leaf D slidably on a guide rail R. The fitting 1 includes a base plate 2 configured to be attached to the door leaf D. The fitting 1 further comprises a support wheel 3, having a rotational axis perpendicular to or along the normal of a plane along which the base plate 2 substantially extends. The support wheel 3 is arranged at the upper portion of the base plate 2. The support wheel 3 may be exchanged by another support means, such as a support roller or other suitable support slider, such as member having a sliding surface extending substantially parallel to the base plate 2, said sliding surface having a friction allowing for the door leaf D to slide comfortably along the guide rail R when the sliding surface is in contact with the guide rail R. Thus, the support means 3 is configured to slidably support the fitting 1 on said rail R. The fitting 1 also comprises an anti-lifting device 4 attached to the base plate 2 via a shank 5. The shank 5 extends in a plane perpendicular to the plane of the base plate 2 and parallel to the rotational axis of the support wheel 3, such that it extends transversally to the longitudinal axis of the guide rail R and in a vertical plane, when the fitting is arranged on said guide rail R. The anti-lifting device 4 is then a pivoting arm arranged at the distal end of the shank 5. The pivoting arm is pivotable in the same plane as the shank 5. The pivoting arm is connected to the distal zone of the shank 5 at the proximal zone of the pivoting arm, such that the distal zone of the pivoting arm may be rotated in the vertical plane (and transversal plane with regard to the longitudinal axis of the guiding rail R) into different positions in relation to the guiding rail R.

The base plate 2 includes four through holes 9, having a non-circular shape for receiving a screw or other suitable fastener, which through holes 9 has a width corresponding to the diameter of the screw and a height being slightly larger than the width. The non-circular shape of the through holes 9 provides a vertical adjustment of the fitting relative the door leaf D. The number of through holes 9 may be other than 4, such as for example 2, 3, or 5.

Further, the base plate 2 is provided with an eccentric 8, configured to be received by a bore in the door leaf D. The eccentric provides further vertical adjustment capabilities of the fitting 1 relative the door leaf D.

Alternately, the base plate 2 may be provided with a back side having a surface being suitable to be attached to the door leaf D by means of an adhesive. The surface of the backside may be rough, or provided with a primer for improving the bonding properties of the adhesive to the fitting. This embodiment is particularly advantageous if the door leaf D is made of a brittle material such as glass.

The anti-lifting device 4 is attached to the base plate 2 via the shank 5 for movement between an idle position and a locked position. In the idle position removal of the fitting 1 from the rail R is enabled, and in the locked position removal of the fitting 1 from the rail R is prevented. This functionality is achieved due to the pivoting arm of the anti-lifting device 4. When the pivot is rotated upwards in the plane of the shank 5 from the idle position to the locked position, the distance between the anti-lifting device 4 and the lower side of the guiding rail R is decreasing, such that the door leaf D may not be tilted and dismounted from the guiding rail R when the anti-lifting device 4 is in its locked position.

The anti-lifting device 4 is attached to the base plate 2 by means of the shank 5 extending from a lateral side of the base plate 2 substantially perpendicularly from said plate 2. Further, the anti-lifting device 4 and the shank 5 are arranged such that the anti-lifting device 4 is rotatable about an axis A substantially parallel to the sliding path P of the fitting 1 when the fitting 1 is attached to the door D.

The shank 5 has a first part 5*a* being attached to the base plate 2, wherein the first part 5*a* of the shank 5 extends parallel with a plane the base plate 2. Preferably, the first part 5*a* of the shank 5 is inserted into a groove of the base plate 2 such that the first part 5*a* is retained in a space formed between the base plate 2 and the door leaf D. A second part 5*b* extends from the first part 5*a* at an angle $\alpha$ relative the plane of the base plate, preferable being in the range of 45° to 135° relative a longitudinal direction of the plane of the base plate 2 and in the range of 45° to 135° relative a transversal direction of the plane of the base plate 2. More preferably, the angle $\alpha$ is 90° relative the longitudinal direction of the plane of the base plate 2 and 90° relative the transversal direction of the plane of the base plate 2. The second part 5*b* further extends transversally to the longitudinal axis of the guiding rail R onto which the fitting 1 is to be arranged. Thus, the shank 5 has an L-shape. The anti-lifting device 4, such as a pivot, is attached to the shank 5 at a distal zone of the second part 5*b*.

Figure 3:
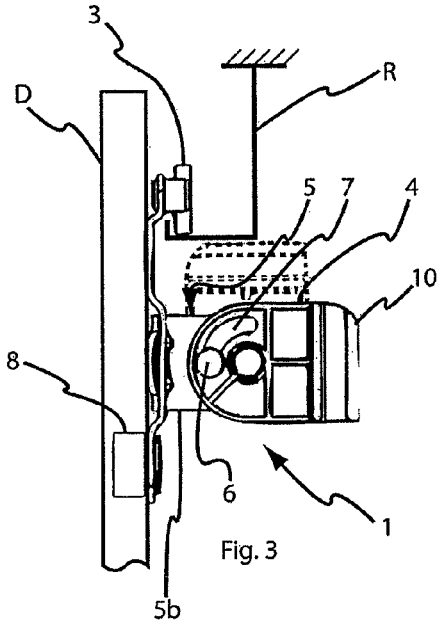
FIG. 3 shows a side view of the fitting shown in FIGS. 1 and 2.
Figure 4:
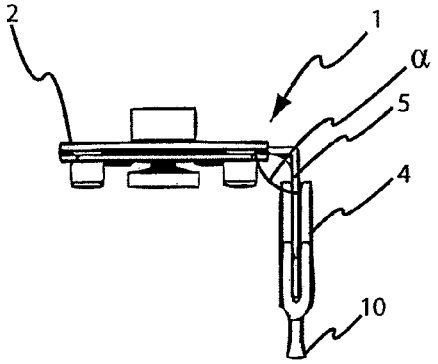
FIG. 4 shows a top view of the fitting shown in FIGS. 1 to 3.
Figure 5:
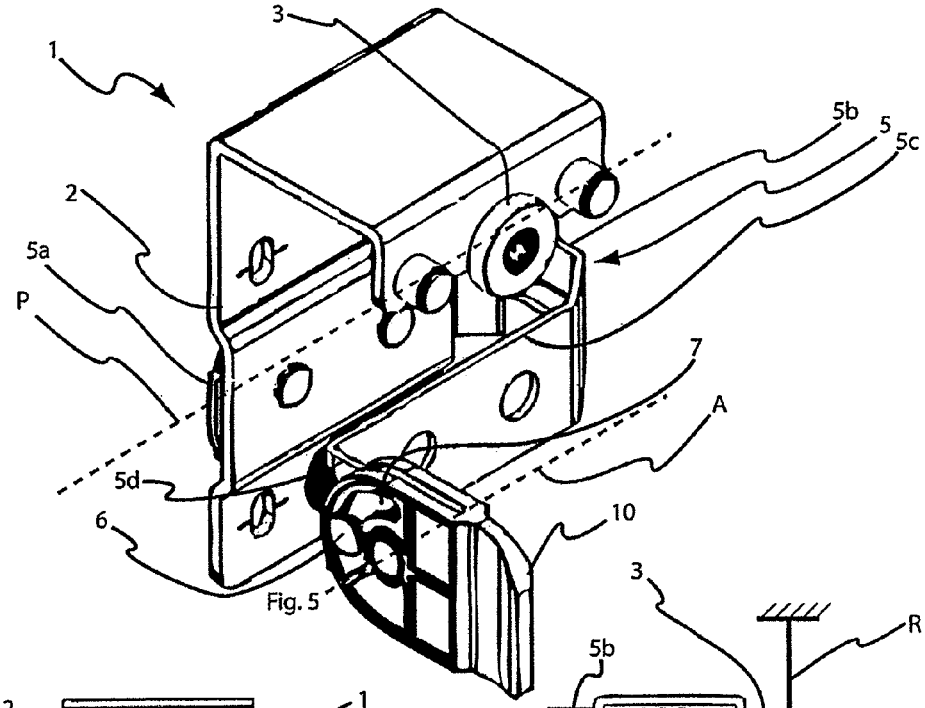
FIG. 5 shows a perspective view of a fitting according to a further embodiment.
Figure 6:
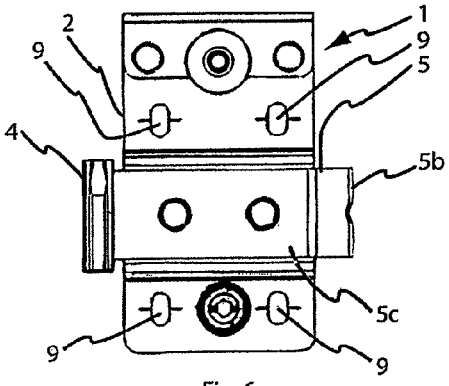
FIG. 6 shows a front view of the fitting shown in FIG. 5.
Figure 7:
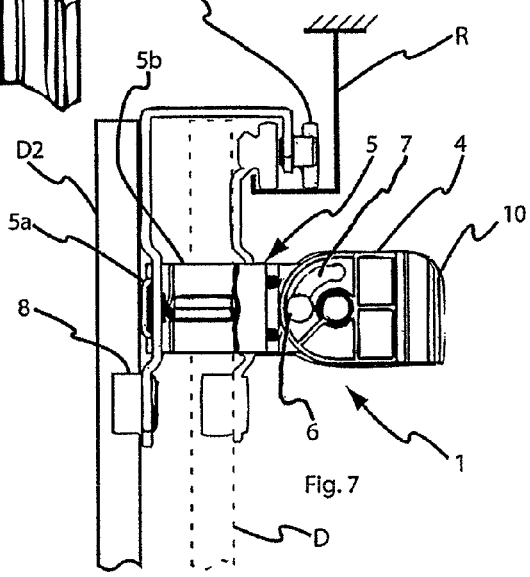
FIG. 7 shows a side view of the fitting shown in FIGS. 5 and 6.
Figure 8:
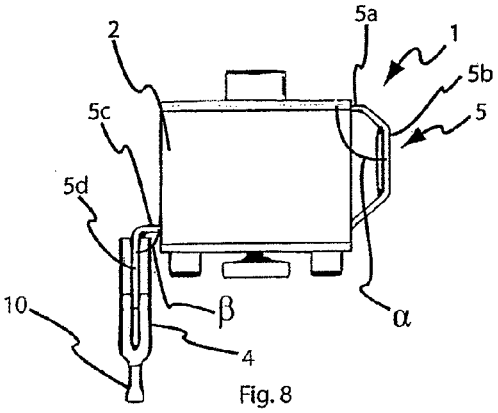
FIG. 8 shows a top view of the fitting shown in FIGS. 5 to 7.

As shown in FIGS. 1 and 3, the shank 5 and the anti-lifting device 4 are provided with a protrusion 6 and a matching recess 7, respectively, configured to limit relative movement between the shank 5 and the anti-lifting device 4 between said idle and locked positions. A pin or rivet is attached to the shank 5 for providing said protrusion 6, and the recess 7 is provided in the anti-lifting device 4 in the form of a semi-circular shaped recess around the rotational axis A of the anti-lifting device 4. A ridge or bump (not shown), is provided at the edge of the recess 7 for providing snap-locking of the protrusion 6 in said closed position.

The protrusion is free to move within the recess until it reaches end portions of the recess preventing further movements. This provides for an easy way of controlling relative movement between the parts.

The semi-circular shape matches the rotational path of movement of the protrusion and thereby the size of the recess can be reduced such that more material is available around the recess to provide improved strength of the part which the recess is provided in. Also, the two end portions of the semi-circular recess provide distinct stops for preventing further movement of the protrusion in the recess. Also, the ridge slightly obstructs movement of the protrusion in said recess such that snap-locking is achieved at selected portions of the recess, such as at the end portions. The snap-locking provided gives tactile feedback to a user moving the anti-lifting device between the idle and the locked positions and also prevents accidental movement of the anti-lifting device, for example due to vibrations.

According to a further embodiment, a fitting 1 is shown in FIGS. 5 to 8. Here, all reference numerals are the same as for those structural components shown in FIGS. 1 to 4. Consequently, the fitting including the base plate and the anti-lifting device all share the same properties as for those components previously being described with reference to FIGS. 1 to 4. However, the base plate is a U-shaped base plate, as will be described below.

Furthermore, the shank 5 includes four parts 5*a-d*, wherein the anti-lifting device 4 is attached to the fourth part 5*d* of the shank 5, wherein the fourth part 5*d* is the most distal part among 5*a-d*. The first part 5*a* and the second part 5*b* has the same structural properties as previously been described, however a third part 5*c* is attached distally to the second part 5*b* and extending in a plane parallel with the first part 5*a*, and in a vertical plane when the fitting 1 is arranged on the guiding rail R. Hence, the third part 5*c* is connected to the second part 5*b* at a perpendicular angle. The first, second, and third parts 5*a-c* then forms a U-shape. A fourth part 5*d* is further connected to the distal end of the third part 5*c* at an angle β and extends in a plane parallel with the second part 5*b* out from the third part 5*c*. Hence, the shank 5 shown in FIGS. 5 to 8 provides that the anti-lifting device 4 is arranged at a greater distance from fitting 1.

The third part 5*c* is preferable arranged in parallel with the first part 5*a* for providing a space between the parts 5*a*, 5*c*. However, the angles α and β, by which the second part 5*b* and fourth part 5*d* are connected, may vary according to different embodiments of the fitting. For example, α may be 80° while β may be 100°.

Correspondingly, the roller 3 is provided at a similar distance from the base plate 2 via an extension of the base plate 2. In this embodiment the base plate 2 is U-shaped, wherein the base plate 2 is connected to a door leaf D2 at the proximal leg of the U-shape, while the roller 3 is connected to the base plate 2 at the distal leg of the U-shape. The roller 3 is further connected to the side of the distal leg of the base plate 2 facing outwardly from the door leaf D2.

The fitting 1 shown in FIGS. 5 to 8 is capable of suspending the door leaf D2 sliding on the outside of the inner door leaf D, preferably being suspended by a fitting 1 as shown in FIGS. 1 to 4.

Hence, by providing the four part shank 5 the inner door leaf D is allowed to occupy a space formed by the distance between the base plate 2 and the third part 5*c* of the shank 5, and the space formed between the legs of the U-shaped base plate.

The base plate 2 may be a piece of sheet metal. The shank 5 may also be a piece of sheet metal which is attached to the base plate 2 by means of two rivets. In other embodiments, the shank 5 may be made integral with the base plate 2 in the form of one piece on bent sheet metal. Other materials of the base plate 2 and the shank 5 may also be considered, such as polymeric materials or different composite materials.

The anti-lifting device 4 may be a piece of injection molded plastics, although other materials and manufacturing methods may be used according to other embodiments. When the anti-lifting device 4 is made of a polymeric material, the static of the idle and locking positions may be enhanced, since the polymeric material will allow for a snap in function between the idle and locking positions, as earlier described above.

A self-closing device (not shown) may further be attached to the guiding rail R for engagement with the fitting 1. In this context a self-closing device is in the form known the skilled person, having a spring loaded catch, which spring load will be released upon interaction between the catch and a ridge to pull the ridge into the closing position. Thereby, the fitting 1 is of advantage in that its laterally positioned anti-lifting device 4 also provides a suitable engagement portion for the self-closing device to engage. When the fitting 1 is to be combined with a self-closing device, the distal end of the anti-lifting device 4 may be provided with a catch member in the form of a ridge 10, to facilitate engagement between the fitting 1 and the self-closing device. Further, since the anti-lifting device 4 is configured to rotate around said axis A, between its idle and its locked position, the self-closing device may be positioned such that it will not be able to engage the anti-lifting device 4 when in its idle position. Hence, the fitting 1 reduces risk of damages to the self-closing device 4 during installation or removal of the door leaf D.

The ridge 10 is preferably provided as an integral part of the anti-lifting device 4 having a tapered profile. The distal part of the anti-lifting device 4, including the ridge 10, may have a first part which acts to prevent the door leaf D from being tilted and a second part forming the ridge 10. The total length of the anti-lifting device 4 may thus vary such that, when the anti-lifting device 4 is in the locked position, the first part of the distal part of the anti-lifting device 4 is arranged below the guiding rail R at a longitudinal distance being slightly smaller than the longitudinal distance between the guiding rail R and the ridge 10. Hence, the self-closing device may have a height which normally would cause the door leaf D to be tilted, but which in this case is prevent due to the provision of the raising of the first part of the distal part.

A sliding door system may be delivered in parts to its place of position, which requires specific mounting instructions to the customer. In the following, the mounting procedure of a sliding door system will be described.

In a first step, the fitting is attached to the door leaf by means of screws insertable in the through holes of the base plate. Preferably the screws are not tightened for allowing vertical adjustment of the fitting relative the door leaf. In a subsequent step, the door leaf is suspended to the guiding rail by positioning of the roller of the fitting into a groove of the guiding rail. The eccentric of the fitting is used to align the door leaf to the guiding rail, and the screws through the fitting are then tightened to provide a fixation of the fitting to the door leaf.

During the procedure so far, the anti-lifting device is in its idle position, i.e. in substantially horizontal alignment, such that the distal end of the anti-lifting device is pointing horizontally. However, the distance between the anti-lifting device and the guiding rail is large enough to allow the door leaf to be dismounted or unhanged from the guiding rail, which therefore requires the customer to turn the anti-lifting device into its locked position, i.e. in substantially vertical alignment, such that the distal end of the anti-lifting device is pointing vertically. The distance between the anti-lifting device and the guiding rail will thus be decreased, such that dismounting is no longer possible.

In case the door leaf is intended to be dismounted from the guiding rail, manual turning of the anti-lifting device into its idle position is required for allowing the door leaf to be tilted and subsequently lifted away from the guiding rail.

All references to upper/lower, first/second, vertically/horizontally, distally/proximally etc should be read in its context as relative definitions. Although specific embodiments have been described it should be appreciated that various modifications may be made to the fitting without departing from the scope as defined in the accompanying claims.

In the claims, the term "comprises/comprising" does not exclude the presence of other elements or steps. Additionally, although individual features may be included in different claims, these may possibly advantageously be combined, and the inclusion in different claims does not imply that a combination of features is not feasible and/or advantageous. In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. A fitting for suspending a sliding door leaf, said fitting comprising:

a base plate having at least one element for attaching said base plate to the door leaf, a support mechanism attached to said base plate for allowing said fitting to be guided by a rail along a sliding path, a shank having a part extending from a lateral end of said base plate at an angle relative to a plane of the base plate, and an anti-lifting device attached to said shank and being moveable between an idle position and a locked position by a rotational movement of the anti-lifting device about an axis being substantially perpendicular to a plane of said shank part, and wherein the anti-lifting device is provided with a catch member for engaging a hook of a self-closing mechanism, wherein the shank is provided with a protrusion and the anti-lifting device is provided with a matching recess configured to define the idle position and the locked position, the recess extending semi-circularly around the rotational axis of the anti-lifting device and comprising a ridge configured to provide for snap-locking of the protrusion in said locked position, and wherein when the anti-lifting device is in the locked position, a distal end of the anti-lifting device is positioned below the support mechanism forming a vertical gap between the distal end of the anti-lifting device and the support mechanism for accommodating the rail.

2. A fitting according to claim 1, wherein said angle is between 45° and 135° relative to a transversal direction of the plane of the base plate, and between 45° and 135° relative to a longitudinal direction of the plane of the base plate.

3. A fitting according to claim 1, wherein said anti-lifting device is arranged at a first longitudinal distance from said support mechanism when the anti-lifting device is in its idle position, and said anti-lifting device is arranged at a second longitudinal distance from said support mechanism when the anti-lifting device is in its locked position, wherein the second longitudinal distance is smaller than the first longitudinal distance.

4. A fitting according to claim 1, wherein said support mechanism is a roller.

5. A fitting according to claim 1, wherein said element for attaching said base plate to a door leaf comprises at least one through hole for receiving a fastener.

6. A fitting according to claim 5, wherein said at least one through hole has a longitudinal extension being slightly larger than a lateral extension for allowing vertical adjustment of the fitting relative the door leaf.

7. A fitting according to claim 5, further comprising at least one eccentric configured to engage a bore of a door leaf for allowing further vertical adjustment of the support mechanism relative the door leaf.

8. A fitting according to claim 1, wherein said shank comprises a first part being attached to said base plate and extending substantially parallel to said base plate, and a second part extending from said first part at said angle relative the plane of the base plate.

9. A fitting according to claim 1, wherein said shank comprises a first part being attached to said base plate and extending substantially parallel to said base plate, a second part extending from said first part at said angle relative the plane of the base plate, a third part extending from said second part and being substantially parallel to said first part, and a fourth part extending from said third part at said angle relative the plane of the base plate.

10. A door leaf in combination with a fitting for suspending the door leaf, said fitting comprising:

a base plate having at least one element for attaching said base plate to the door leaf, a support mechanism attached to said base plate for allowing said fitting to be guided by a rail along a sliding path, a shank having a part extending from a lateral end of said base plate at an angle relative to a plane of the base plate, and an anti-lifting device attached to said shank and being moveable between an idle position and a locked position by a rotational movement of the anti-lifting device about an axis being substantially perpendicular to a plane of said shank part, and wherein the anti-lifting device is provided with a catch member for engaging a hook of a self-closing mechanism, wherein the shank is provided with a protrusion and the anti-lifting device is provided with a matching recess configured to define the idle position and the locked position, the recess extending semi-circularly around the rotational axis of the anti-lifting device and comprising a ridge configured to provide for snap-locking of the protrusion in said locked position, and wherein when the anti-lifting device is in the locked position, a distal end of the anti-lifting device is positioned below the support mechanism forming a vertical gap between the distal end of the anti-lifting device and the support mechanism for accommodating the rail.

11. A sliding door system in combination with a guiding rail, at least one door leaf, and a fitting for suspending the at least one door leaf, said fitting comprising:

a base plate having at least one element for attaching said base plate to the door leaf, a support mechanism attached to said base plate for allowing said fitting to be guided by a rail along a sliding path, a shank having a part extending from a lateral end of said base plate at an angle relative to a plane of the base plate, and an anti-lifting device attached to said shank and being moveable between an idle position and a locked position by a rotational movement of the anti-lifting device about an axis being substantially perpendicular to a plane of said shank part, and wherein the anti-lifting device is provided with a catch member for engaging a hook of a self-closing mechanism, wherein the shank is provided with a protrusion and the anti-lifting device is provided with a matching recess configured to define the idle position and the locked position, the recess extending semi-circularly around the rotational axis of the anti-lifting device and comprising a ridge configured to provide for snap-locking of the protrusion in said locked position, and wherein when the anti-lifting device is in the locked position, a distal end of the anti-lifting device is positioned below the support mechanism forming a vertical gap between the distal end of the anti-lifting device and the support mechanism for accommodating the rail.

12. The fitting of claim 2, wherein the angle is 90° relative to a transversal direction of the plane of the base plate.

13. The fitting of claim 2, wherein the angle is 90° relative to a longitudinal direction of the plane of the base plate.

* * * * *